US005276922A

United States Patent [19]

Floyd, Jr.

[11] Patent Number: 5,276,922

[45] Date of Patent: Jan. 11, 1994

[54] GLOVE WITH OPENER FOR A BARTENDER

[76] Inventor: George M. Floyd, Jr., 4724 Lockewood La., Columbia, S.C. 29205

[21] Appl. No.: 938,200

[22] Filed: Aug. 28, 1992

[51] Int. Cl.[5] ..... A41D 19/00

[52] U.S. Cl. ..... 2/160

[58] Field of Search ..... 2/159, 160, 161 R, 161 A, 163; 224/217, 218, 219, 220

[56] References Cited

U.S. PATENT DOCUMENTS

| | | | |
|---|---|---|---|
| 892,812 | 7/1908 | Day | 224/217 |
| 1,163,866 | 12/1915 | Sexton | 224/217 |
| 1,286,610 | 12/1918 | Harriman | 224/217 |
| 2,294,997 | 9/1942 | Merrion | 2/160 |
| 3,500,477 | 3/1970 | Meszaros | 2/161 |
| 3,629,867 | 12/1971 | Taylor | 2/160 |
| 4,326,706 | 4/1982 | Guthrie et al. | 2/160 |
| 4,414,692 | 11/1983 | Dzierson et al. | 2/160 |
| 4,447,912 | 5/1984 | Morrow | 2/160 |
| 4,504,980 | 3/1985 | Butcher | 2/160 |
| 4,586,387 | 5/1986 | Morgan et al. | 2/160 X |
| 4,805,238 | 2/1989 | Crafts | 2/161 |
| 4,894,866 | 1/1990 | Walker | 2/161 |
| 5,088,121 | 2/1992 | Wallace | 2/160 |
| 5,133,233 | 7/1992 | Erwin | 2/160 X |

FOREIGN PATENT DOCUMENTS

| | | | |
|---|---|---|---|
| 1167661 | 10/1969 | United Kingdom | 2/158 |

*Primary Examiner*—Clifford D. Crowder
*Assistant Examiner*—Michael A. Neas
*Attorney, Agent, or Firm*—Michael A. Mann

[57] ABSTRACT

A glove used by a bartender having various equipped with various devices for performing bartender's tasks. The glove has an opener attached to the upper palm area for opening beverage bottle crown caps, and a reinforced area between the thumb and index finger for twisting off beverage container caps. In the preferred embodiment, the glove also has holders for a cigarette lighter that can be actuated by the thumb and for a small pencil. The glove covers the palm of the hand and a portion of the fingers, and is made of a washable material, such as mesh.

11 Claims, 3 Drawing Sheets

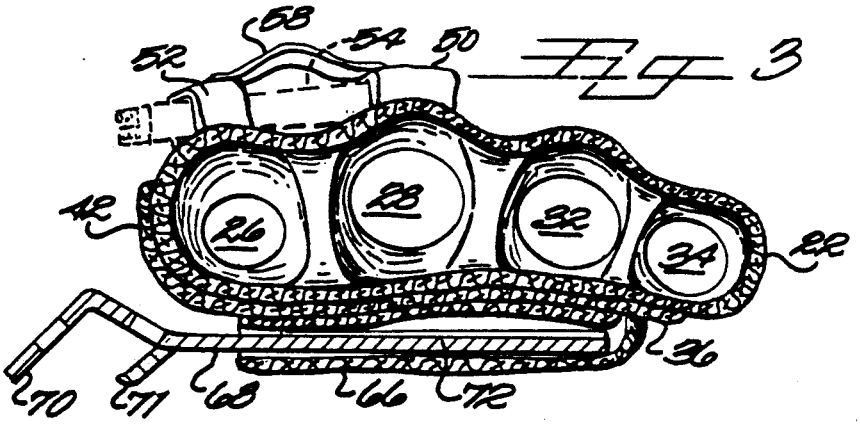
Fig 3
Fig 4
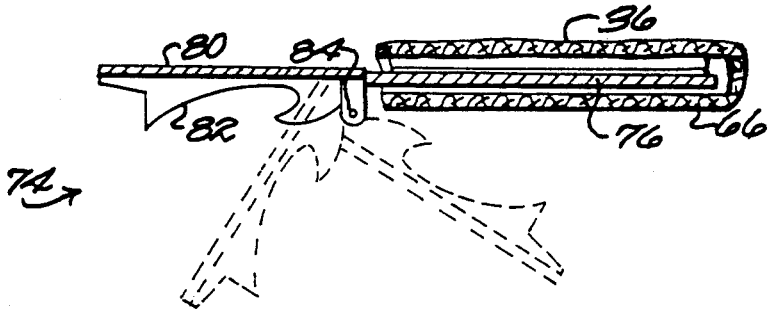
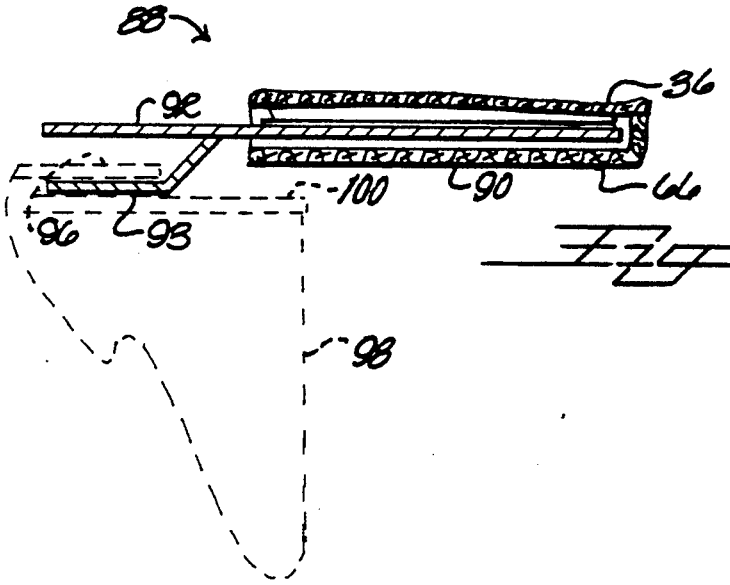
Fig 5

GLOVE WITH OPENER FOR A BARTENDER

BACKGROUND OF THE INVENTION

1. Field of the Invention

The present invention relates to gloves. More particularly, the present invention relates to a glove used by professional bartenders in tending bar.

2. Discussion of Background

Gloves for purposes other than keeping hands warm are well known as article of manufacture. Furthermore, gloves having a tool or other device attached to the palm or top of the glove are not new. Many different types of devices have been attached to a glove or partial glove for a number of reasons, including carrying convenience and use, hand protection, and the like.

In U.S. Pat. No. 2,294,997, Merrion discloses a glove equipped with a tool carrier in the palm of the glove. Similarly, Morrow, in U.S. Pat. No. 4,447,912, describes a glove with an attachment for holding a toothbrush and other instruments of the kind, preferably for use by injured or physically handicapped persons having difficulty operating or manipulating their hands.

Several gloves have attachments for carrying convenience while walking or jogging. Butcher (U.S. Pat. No. 4,504,980) and Wallace (U.S. Pat. No. 5,088,121) both describe a glove having a palm area equipped to carry a means of protection, such as a can of mace or tear gas. Similarly, Guthrie et al, in U.S. Pat. No. 4,326,706, describe a glove, worn by joggers, that can carry weights in the palm and on the back of the glove.

Taylor, in his U.S. Pat. No. 3,629,867, describes a glove having a pencil holder on the back of the glove or top of the hand area. The pencil or other writing instrument is simply removed from the holder by the opposite hand when needed for use, and subsequently inserted back into the holder after use.

Specialized gloves for use by bartenders are also known in the art. For instance, Crafts (U.S. Pat. No. 4,805,238) describes a glove equipped with a bottle cap opener that twists off crown caps and is attached directly in the palm area of the glove. In use, the bartender places the crown cap into a recess formed in a thickened portion of the palm that engages the cap and enables the bartender to twist the cap. The cap protects the palm of a bartender and eliminates the need to pick up a bottle opener since the opener is incorporated into the glove.

Another similar device used especially by bartenders is disclosed by Walker, in U.S. Pat. No. 4,894,866. The glove has a leather gripping area between the forefinger, thumb, and the juncture there between for twisting caps of bottles to remove them. The partial glove fits over the thumb and forefinger, and fastens around the wrist with an adjustable band.

Beverages sold at bars comes in a variety of containers with different types of closures. Typically, beer comes in bottles with crown caps. Some crown caps can be opened by twisting and are called twist-off caps. All crown caps can be removed by leveraging. Other bottles such as liquor bottles, both full size and so-called "mini-bottles" required by some state governments, have threaded caps that are removable by twisting them off. Beverages such as beer and soft drinks are typically sold in cans with tab openers that are pried up and back away from the can to open a small hole in the can top.

Despite the existence of bartender's gloves for twisting off bottle caps, it is believed that no glove for bartenders provides a more convenient method for prying off both twist off and non-twist off bottle caps and opening cans with tab openers.

SUMMARY OF THE INVENTION

According to its major aspects and broadly stated, the present invention is a glove for use by a bartender. In particular, it is a glove equipped with devices enabling a bartender to perform his tasks more easily, especially opening beverage containers. The glove has an opener attached to the upper palm area for prying or lifting off beverage bottle crown caps, and a reinforced area between the thumb and index finger for twisting off beverage container caps. Also, the glove has a holder for a lighter actuated by the thumb, and a loop for holding a small marker in a position so that it can make marks for keeping track of rounds of drinks, for example. The glove covers the palm of the hand and a portion of the fingers, and is made of a washable material, such as a synthetic mesh.

A major feature of the present invention is the combined features of twisting off bottle caps with the reinforced thumb and forefinger area and prying off bottle caps with the attached opener. The advantage of this combination is that both types of beverage bottles can be opened easily, including bottles with twist-off caps and bottles with caps that must be pried off with an opener.

Another feature of the present invention is the reinforcement along the thumb and forefinger areas of the glove. This feature enhances a bartender's ability to twist off beverage bottle caps using a padded, frictionally engaging material that is incorporated into the glove. In addition to protecting the hand, this feature also eliminates the time spent looking for other twist-off devices, such as small sheets of rubber and the like.

Still another feature of the present invention is the securing of a beverage bottle opener in a specific location within a pocket across the upper palm area of the glove. The position of the opener in its pocket allows the fingers to wrap around the opener body just prior to its use, while not causing any interference with the use of the reinforced area when twisting off bottle caps. The opener in the pocket is held securely in the correct position—with the operating end just beyond the palm—for immediate use. This feature eliminates the time spent looking for and obtaining the opener and returning the opener to its proper place.

There are two other tools of bartending also carried by the glove in its preferred embodiment: a cigarette lighter and a marker. Bartenders are frequently asked by a patron for a light for a cigarette or light the cigarettes of their patrons as a curtsey. Having a cigarette lighter conveniently carried by the bartender's glove is convenient. Having a marker on the glove for keeping track of rounds of drinks is also convenient. The marker need only be a short pencil or felt-tipped marker capable of making a "tick" mark on a coaster or scratch pad.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 3 is a cross-sectional view of the glove taken along lines 3—3 of FIG. 2;

FIG. 4 is a partial cross-sectional view of an alternative opener for use with the glove of FIG. 1 according to an alternative embodiment;

FIG. 5 is a partial cross-sectional view of an alternative opener for use with the glove of FIG. 1 showing a tabbed beverage can being opened;

DETAILED DESCRIPTION OF A PREFERRED EMBODIMENT

Figure 1:
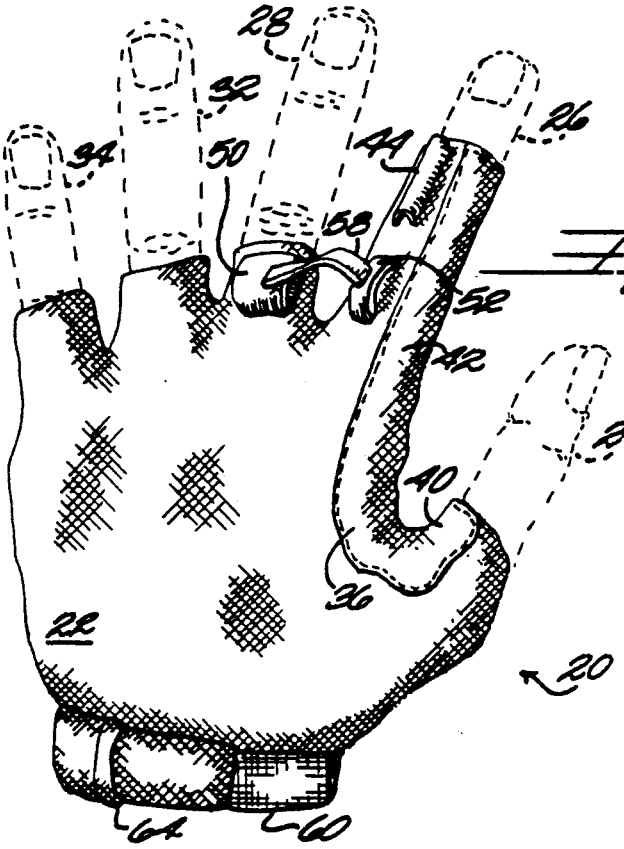
FIG. 1 is a perspective view of the top of a left-handed bartender's glove according to a preferred embodiment of the present invention.

In the following description similar components are referred to by the same reference numeral in order to simplify the understanding of the sequential aspect of the drawings.

Referring now to FIG. 1, the back of a bartender's glove 20 in its preferred embodiment is a fabric 22, preferably a washable mesh material, covering the hand and at least parts of the thumb and fingers and may have attached to it an advertising logo or other lettering. Preferably, glove 20 covers thumb 24 up to somewhere between its inner or outer metacarpal knuckle joint, index finger 26 up to its outer metacarpal knuckle joint, and second finger 28, third finger 32, and fourth finger 34 up to their inner metacarpal knuckle joints.

Attached to fabric 22 is a reinforced material 36 providing padding for an area 40 along the inside edge of thumb 24 and continuing up along an area 42 along the inside edge of index finder 26. Reinforced material 36 provides padding for protection of the hand and also for frictionally engaging a twist-off cap when removing it from a beverage bottle, as described herein.

Figure 6:
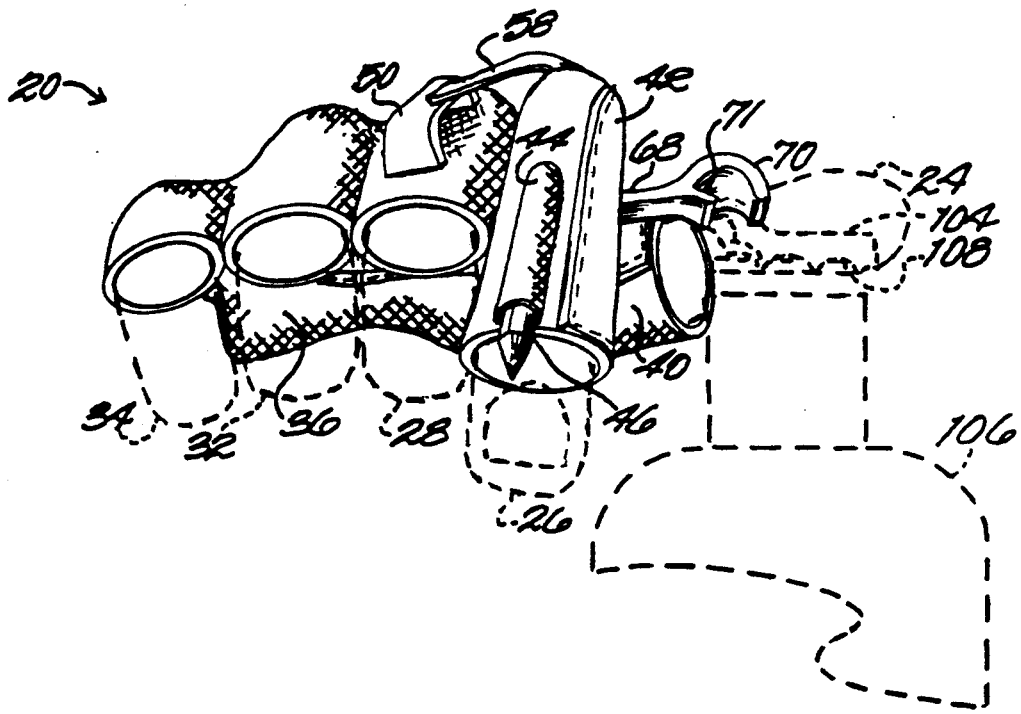
FIG. 6 is a perspective view of the glove of FIG. 1 according to a preferred embodiment, showing a bottle with a cap that must be pried off being opened.

Along the top of the portion of glove 20 covering index finger 26, fabric 22 has attached to it a holder 44 for a small pencil 46 or other marking instrument (shown in FIG. 6). Holder 44 positions pencil 46 in a position so that a bartender can make a single mark or write a note when the outer metacarpal knuckle joint of the index finger 26 is slightly bent. Such a writing could be used, for instance, in keeping the count of the number of beverages a patron has ordered over a period of time.

Referring again to FIG. 1, across the top of the portion of glove 20 covering second finger 28, fabric 22 has attached to it a bottom portion 50 and, across the top of the portion of glove 20 covering index finger 26, fabric 22 has attached to it a top portion 52; both portions 50, 52 are for securing a cigarette lighter 54 (shown in FIG. 3). A narrow strap 58, attached to bottom portion 50 and top portion 52 provides stability in securing lighter 54, while still allowing essentially complete mobility of index finger 26 and second finger 28 with respect to each other.

A wrist strap 60 attached to fabric 22 preferably wraps around the bartender's wrist to secure glove 20 to the bartender's hand. Preferably, wrist strap 60 has an adjustable fastener 64 that adapts to the individual wrist size of the bartender for proper wearing of glove 20.

Figure 2:
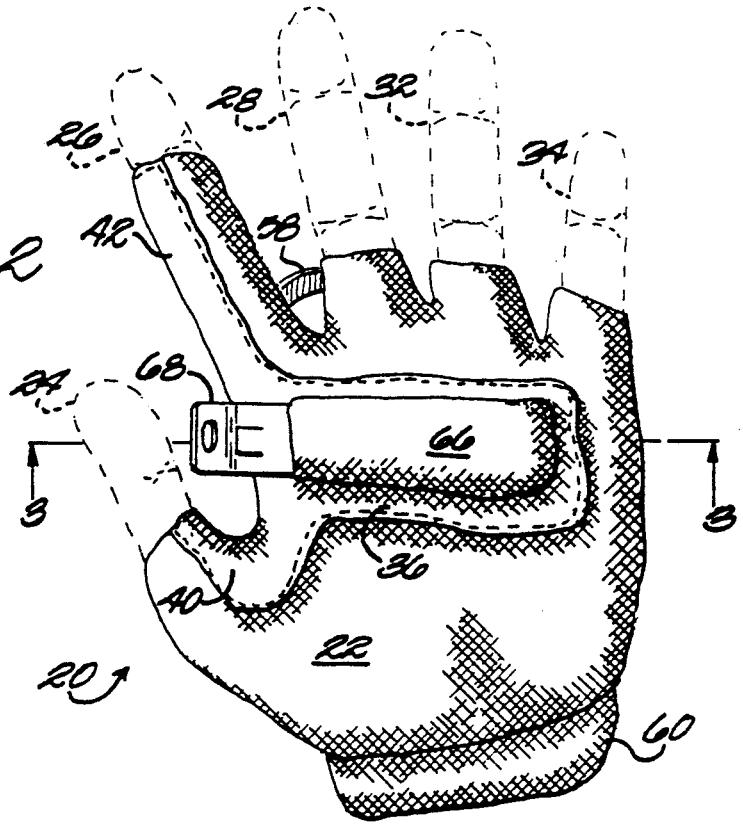
FIG. 2 is a perspective view of the bottom or underside of the bartender's glove of FIG. 1.

Referring now to FIG. 2, the front side of glove 20 is shown. As can be seen, reinforced material 36, attached to fabric 22, extends across the upper palm area of the hand. Attached to reinforced material 36 across the upper palm area of the hand is a pocket 66 for securely carrying an opener 68, preferably an opener adapted for removing crown-caps from beverage bottles. Pocket 66 is preferably positioned along the upper palm area of the hand so that when opener 68 is secured within pocket 66, opener 68 extends just past the palm, at the juncture between thumb 24 and index finger 26, thereby not interfering with a bartender when the bartender is using areas 40 and 42 to remove twist-off caps from beverage bottles.

In FIG. 3, pocket 66 can be seen attached to reinforced material 36, which itself can be seen attached to fabric 22. Opener 68 is seen secured within pocket 66. Also, lighter 54 is shown being held by bottom portion 50, top portion 52, and strap 58. Preferably, lighter 54 is of the size whereby, when held, lighter 54 extends slightly across the inside edge of index finger 26. Thus, lighter 54 is positioned so that when index finger 26 and second finger 28 are partially curled toward the palm area of the hand, lighter 54 can be actuated by thumb 24.

Opener 68 has a lower portion 72 preferably dimensioned to fit within pocket 66, yet will not fall out of pocket 66 easily. Lower portion 72 is preferably shaped to fit the contour of the palm area of the hand, or alternatively, can be straight and flat (as shown), so long as it fits within pocket 66.

Also, opener 68 has an operating end featuring an upper ledge 70 and a lower ledge or tongue 71. Ledge 70 and tongue 71 work together to efficiently pry a crown-cap from a beverage bottle.

FIG. 4 shows a cross-section of an alternative opener 74 having a lower portion 76 that fits within pocket 66. Lower portion 76 can be straight and flat (as shown) or can be fabricated with a contoured surface to fit the shape of the upper palm area of the hand. Opener 74 has a blade 80 featuring a specially shaped face 82 adapted to remove crown-caps from beverage bottles. Blade 80 folds about a pivot 84, allowing blade 80 to fold up against the upper palm area of the hand when opener 74 is not in use.

In FIG. 5, the cross-section of a second alternative opener 88 is shown. Opener 88 has a lower portion 90 that fits within pocket 66. Lower portion 90 can be straight and flat (as shown) or can be fabricated with a contoured surface to fit the shape of the upper palm area of the hand.

Opener 88 has an operating end featuring a ledge 92 and a tongue 93, and is similar to opener 68 (see FIG. 3) except that ledge 92 of opener 88 is not recessed, as is ledge 70 of opener 68. Also, tongue 93 of opener 88 is much longer than tongue 71 of opener 68, thus allowing opener 88 to be used to leverage a tab 96 of a beverage can 98 away from a surface 100 of can 98, thereby opening can 98. In using opener 88 to open beverage can 98, tongue 93 is simply inserted under tab 96 and lifted away from surface top surface 100 of can 98.

In FIG. 6, glove 20 is shown using opener 68 to pry a crown-cap 104 off of a beverage bottle 106. In using opener 68, ledge 70 is used to establish a fulcrum point on the top side of crown-cap 104 while tongue 71 engages a lower edge 108 of the lip of crown-cap 104. Tongue 71 is then rotated away from bottle 106, thereby working in conjunction with ledge 70 to pry crown-cap 104 off of beverage bottle 106. During the use of opener 68, fingers 26, 28, 32, 34 are typically curled around pocket 66, which is carrying lower portion 72 of opener 68, thus adding stability to opener 68 during its use.

Figure 7:
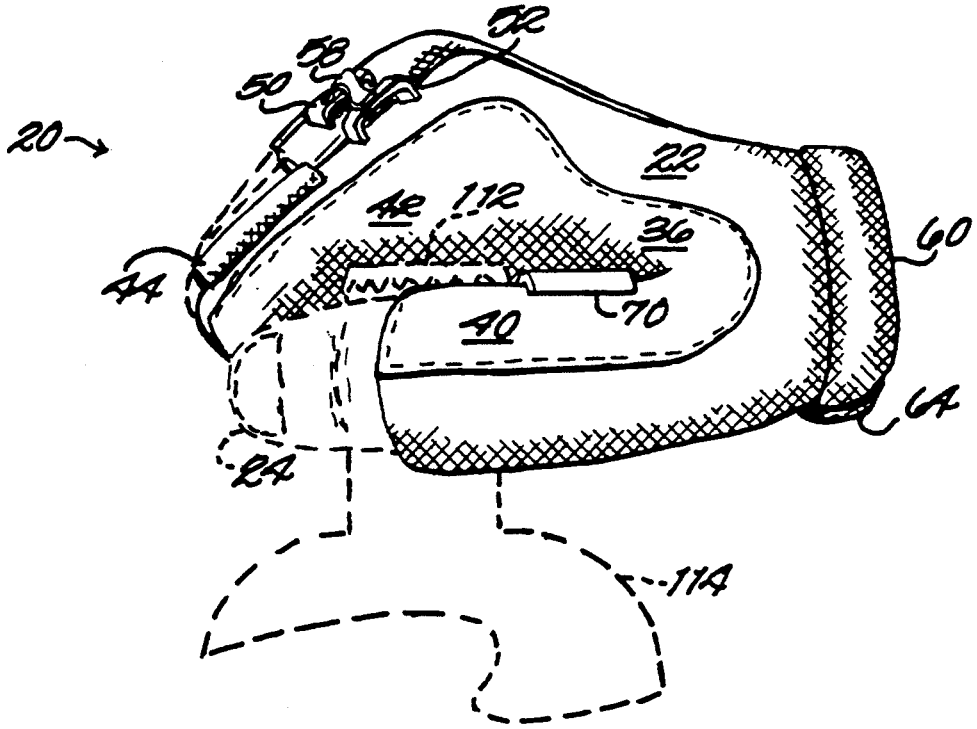
FIG. 7 is a perspective view of the glove of FIG. 1 according to a preferred embodiment, showing a bottle with a twist-off cap being opened.

FIG. 7 shows reinforced material 36 being used to remove a twist-off cap 112 from a beverage bottle 114. It can be seen that reinforced material 36, particularly area 42 along the inside edge of index finger 26 and area 40 along the inside edge of thumb 24, is used to frictionally engage twist-off cap 112 during its removal from bottle 114. As stated previously, opener 68 (not shown) is positioned within pocket 66 (see generally FIG. 2) so that ledge 70 of opener 68 does not interfere with the use of reinforced material 36 in removing twist-off cap 112.

It will be apparent to those skilled in the art that many changes and substitutions can be made to the preferred embodiment herein described without departing from the spirit and scope of the present invention as defined by the appended claims.

What is claimed is:

1. A glove to be worn on a hand and for use by a bartender in removing crown caps and twist-off bottle caps, said glove comprising:

an opener having an operating end and an end opposing said operating end, said operating end adapted for removing crown caps by leverage from a beverage bottle;

a fabric having a first portion covering at least part of the palm of said hand, a second portion covering at least part of the thumb and index finger of said hand, and a third portion covering the back of said hand and attached to said first and said second portions;

pocket carried by said first portion of said fabric and having an opening toward the thumb and index finger of said hand, said pocket dimensioned to receive said opener so that said operating end of said opener extends out of said pocket toward the thumb and index finger of said hand;

means carried by said second portion of said fabric for reinforcing said second portion of said fabric when said second portion is used to twist said twist-off bottle caps; and a cigarette lighter;

means carried by said third portion for securing said cigarette lighter to said glove so that said thumb can actuate said cigarette lighter.

2. The glove as recited in claim 1, further comprising first means for securing said opener in position within said pocket.

3. The glove as recited in claim 1, wherein said first portion covers at least a portion of the user's first and second fingers and said glove further comprises:

a cigarette lighter;

second means for securing said cigarette lighter to said glove against said first portion where said first portion covers said first and second fingers so that said thumb can actuate said cigarette lighter.

4. The glove as recited in claim 1, wherein said first portion covers at least a portion of the user's first finger and said glove further comprises:

a marker; and means for holding said marker in a position so that said marker can make a mark.

5. The glove as recited in claim 1, wherein said first portion covers at least a portion of the user's first finger and said glove further comprises:

a marker; and means for holding said marker to said first portion where said first portion covers said first finger so that, when said glove is worn and said first finger is bent, said marker can make a mark.

6. The glove as recited in claim 1, said glove for use with a marking instrument and further comprising means for holding said marking instrument, said holding means carried by said second portion of said fabric, said holding means holding said marking instrument so that said marking instrument extends past the outer metacarpal knuckle joint on the back of the index finger of said hand so that said marking instrument can make a mark when said index finger is bent.

7. The glove as recited in claim 1, wherein said reinforcing means is made of a material that frictionally engages said twist-off bottle caps when said twist-off bottle caps are rotated with respect to said beverage bottle.

8. The glove as recited in claim 1, further comprising second means for securing said glove to the wrist of said hand of said bartender.

9. The glove as recited in claim 1, wherein said fabric is made of a washable material.

10. An article of manufacture for use by a bartender, said article comprising:

a glove formed to fit a hand, said glove made of a washable mesh material and having a palm portion, a thumb portion, an index finger portion, a second finger portion, a third finger portion, and a fourth finger portion, said palm portion attached to said thumb, index finger, second finger, third finger and fourth finger portions, said thumb portion covering a thumb up to the outer metacarpal knuckle joint of said thumb, said index finger portion covering an index finger up to the outer metacarpal knuckle joint of said index finger, said second finger portion covering a second finger up to the inner metacarpal knuckle joint of said second finger, said third finger portion covering a third finger up to the inner metacarpal knuckle joint of said third finger, said fourth finger portion covering a fourth finger up to the inner metacarpal knuckle joint of said fourth finger, said index finger portion and said thumb portion connected by a juncture portion;

a first reinforcing material carried by at least a part of said palm portion; a pocket carried by said first reinforcing material of said palm portion of said glove;

an opener carried by said pocket, said opener having an operating end and an end opposing said operating end, said opener carried within said pocket so that said operating end extends beyond said pocket toward said index finger and said thumb, said operating end having means formed therein for removing said crown cap from said beverage bottle by levering said crown cap, said end opposing said operating end being substantially smooth and being contoured to fit against said upper palm;

means for securing said opener in position within said pocket;

a second reinforcing material carried by said glove and running from said thumb portion to said index finger portion, said second reinforcing material adapted for frictionally engaging a bottle cap for removing said bottle cap by twisting;

means for securing a cigarette lighter to said index finger portion and said second finger portion, said securing means positioning said lighter so that said thumb can actuate said lighter;

a cigarette lighter secured within said securing means;

a marking instrument; and means for holding said marking instrument to said glove so that said marking instrument extends just beyond said outer metacarpal knuckle joint on said top side of said index finger so that the user can make a mark with said marking instrument when said index finger is bent.

11. The article as recited in claim 10, wherein said glove further comprises means for securing said glove to said hand, said securing means having an adjustable fastening means adapted to encircle the wrist of said hand.

* * * * *